United States Patent [19]

Blaser

[11] Patent Number: 4,521,979

[45] Date of Patent: Jun. 11, 1985

[54] SHOCK ABSORBING SHOE SOLE

[76] Inventor: Anton J. Blaser, 700 E. Mason St., Santa Barbara, Calif. 93101

[21] Appl. No.: 585,271

[22] Filed: Mar. 1, 1984

[51] Int. Cl.[3] ..... A43B 13/20

[52] U.S. Cl. ..... 36/29; 36/28; 36/43; 36/59 C

[58] Field of Search ..... 36/29, 28, 59 C, 43, 36/44, 7.8

[56] References Cited

U.S. PATENT DOCUMENTS

| | | | |
|---|---|---|---|
| 871,864 | 11/1907 | Feazell et al. | 36/7.8 |
| 1,141,227 | 6/1915 | Bailey | 36/59 C |
| 4,267,648 | 5/1981 | Weisz | 36/28 |
| 4,322,893 | 4/1982 | Halvorsen | 36/28 |

*Primary Examiner*—Werner H. Schroeder
*Assistant Examiner*—Mary A. Ellis
*Attorney, Agent, or Firm*—Ralph B. Pastoriza

[57] ABSTRACT

The shoe sole can either be external or constitute an inner sole to be received within the shoe. It includes a supporting pad having a plurality of circular recesses formed in its underside. A like plurality of identical individual enclosures of resilient material cover the recesses. Each enclosure comprises a series of annular walls successively axially spaced from the recess associated with the enclosure and having successively decreasing diameters, the walls being in partially nested relationship and connected together by a thinner portion of material. The arrangement is such that the enclosure or air chamber will collapse in a telescoping manner wholly within the recess of the pad when walking pressure is applied to the enclosure. Air can escape from each of the enclosures through specially designed openings. The repetitive compression and expansion of the enclosures with each step results in a shock absorbing and cushioning action by the sole.

7 Claims, 16 Drawing Figures

SHOCK ABSORBING SHOE SOLE

FIELD OF THE INVENTION

This invention relates generally to cushioning material and more particularly to an improved shock absorbing and cushioning shoe sole.

BACKGROUND OF THE INVENTION

Various different types of shoe treads are well known in the art. Usually such treads constitute solid rubber or equivalent resilient material provided with grooves or the like similar to a tire tread, to increase traction and also increase the resiliency and thereby the cushioning effect of the tread. It is also known to provide inner soles for shoes of spongelike material to again provide a cushioning effect.

Usually the solid rubber tread provided on the shoes while exhibiting good anti-skid quality will not really cushion the shoe to the extent often desirable. On the other hand, inner soles of spongy material, while initially providing good comfort, tend to become heated and also packed down after prolonged use, so that the cushioning qualities disappear.

Some of the foregoing disadvantages have been solved by providing soles with a large number of individual air pockets or enclosures which will collapse when walking on the sole. The enclosures themselves have small air openings so that the sole can "breathe" as they are repeatedly compressed and permitted to expand. An example of such structure is in German Pat. No. 474,016 of Feb. 12, 1928. Another example of such structures is shown in U.S. Pat. No. 2,358,342.

While a great improvement is provided with individual air chambers or enclosures, there still can result some problems. More particularly, the geometry of the enclosures is often such that when they collapse under the weight of a person's foot, the resistance force during the collapsing cycle varies enormously. Initially, the air chambers will collapse very easily but as they become more compressed, a greater resistance force is offered. When the chambers are completely collapsed, they form a small lump or nub on the sole which is not particularly comfortable for the wearer.

In view of the foregoing, there still exists a need for an appropriately designed shoe shole providing desired shock absorbing characteristics together with comfort.

BRIEF DESCRIPTION OF THE PRESENT INVENTION

With the foregoing in mind, the present invention contemplates an improved shock absorbing shoe sole which could be used as a shoe tread or as an inner sole for a shoe to provide increased comfort. The configuration of the shoe sole is such that consistent and prolonged shock absorbing and cushioning qualities are realizable so that the disadvantages of prior art treads, air chambers and the like are avoided.

More particularly, in its broadest aspect, the shock absorbing shoe sole of this invention includes a supporting pad having a plurality of circular recesses in its underside. A like plurality of identical individual enclosures covers the recesses. Each enclosure comprises a series of annular walls successively axially spaced from the recess associated with the enclosure and having successively decreasing diameters. The walls themselves are in partially nested relationship and the extending end of each wall connects to the beginning end of the next successive wall so that an accordion pattern results. The enclosure itself defines an air chamber. Some of the connecting portions of the walls have air escape openings. The overall construction is such that when a person walks on the sole, the air chambers or enclosures are repeatedly collapsed in telescoping style wholly within their associated recesses so that there do not result lumps or the like. Further, the telescoping arrangement assures a fairly uniform resistance pressure to collapsing rather than a highly variable resistance.

The collapsing and expanding repetitively with each step results in a "breathing" of the sole which keeps the foot cool and at the same time results in a shock absorbing and cushioning action by the sole.

BRIEF DESCRIPTION OF THE DRAWINGS

A better understanding of this invention will be had by now referring to the accompanying drawings in which.

DETAILED DESCRIPTION OF THE INVENTION

Figure 1:
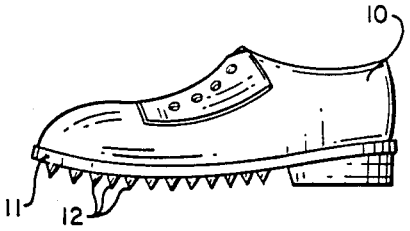
FIG. 1 is a side elevational view of a shoe incorporating the sole of this invention on its exterior to function as a tread.

Referring first to FIG. 1, there is shown a shoe 10 provided with an exterior sole made up of a supporting pad 11 and a plurality of identical individual enclosures of resilient material 12. These individual enclosures are supported on the underside of the pad 11 as shown. They thus function as a tread for the shoe 10.

Figure 2:
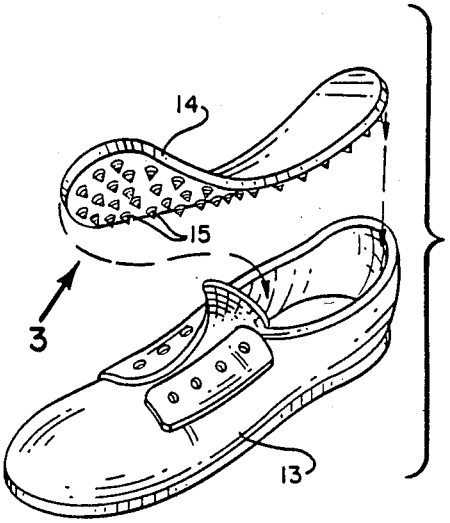
FIG. 2 is an exploded perspective view of a shoe wherein there is provided an inner sole for reception in the shoe in accord with the present invention.

FIG. 2 illustrates another embodiment of the invention wherein again there is provided a shoe 13 having a conventional outer sole but capable of receiving an inner sole designed in accord with the present invention. This inner sole includes again a supporting pad 14 having a plurality of indentical individual enclosures of resilient material 15 supported on the underside of the pad.

The purpose for FIGS. 1 and 2 is simply to illustrate that the present invention, made up essentially of the pad and enclosures, can be used either externally or internally of a shoe. It should be understood that in the ensuing description, the embodiment disclosed could be utilized externally of the shoe as shown in FIG. 1, or internally as illustrated in FIG. 2.

Figure 3:
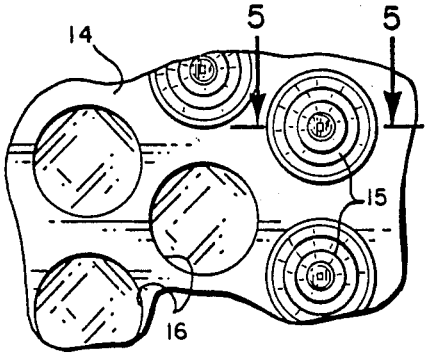
FIG. 3 is a greatly enlarged bottom view of a portion of the sole looking in the direction of the arrow 3 of FIG. 2.
Figure 4:
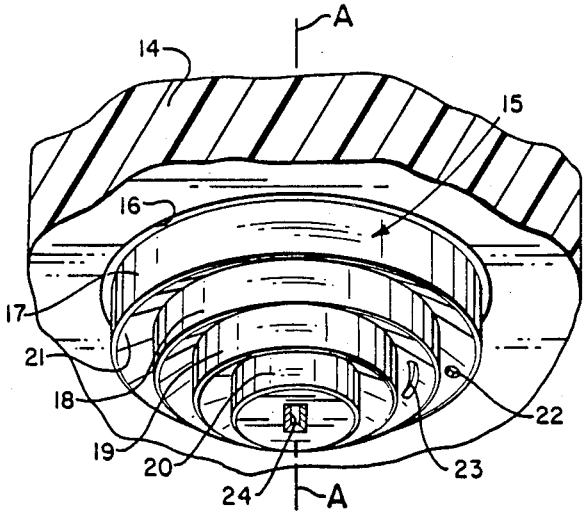
FIG. 4 is a greatly enlarged fragmentary perspective view of a portion of the underside of the sole illustrated in FIG. 3.

Referring now to FIG. 3, and the fragmentary enlarged perspective view of FIG. 4, further details of the invention will become evident. As shown, the plurality of individual enclosures 15 described briefly in FIG. 2 are uniformly spaced and supported on the underside of the pad 14. In FIG. 3, some of the enclosures have been omitted to render visible a plurality of circular recesses 16 formed on the underside of the sole. It will be understood that the enclosures 15 cover these recesses and are so designed as to be wholly received within the circular recesses 16 when in a collapsed condition.

The manner in which the foregoing takes place will be evident by referring now specifically to FIG. 4 which shows a typical one of the enclosures 15. This enclosure comprises a series of annular walls 17, 18, 19 and 20 successively axially spaced along an axis A—A corresponding to the axis of the circular recess 16. Each annular wall has successively decreasing diameters as shown, the walls being in partially nested relationship. The extending end of each wall connects to the beginning end of the next successive smaller diameter wall so that an accordian or telescoping pattern results. In FIG. 4 it will be noted that the extending end of the wall 17 is connected to the beginning end of the wall 18 by the connecting portion 21 and therefore guided to collapse in proper position into the larger recess 16.

The enclosures defined by the annular walls and connecting portions define air chambers. Some of the portions of the walls have air escape openings such as at 22 for the portion 21 wherein a small hole can be provided. An alternative for the air escape opening could be an elongated arcuate type slot such as indicated at 23 for the next connecting portion between the walls 18 and 19. The end of the smallest diameter wall, in turn, includes an air slot 24 which acts as a new type of air pressure valve.

Figure 5:
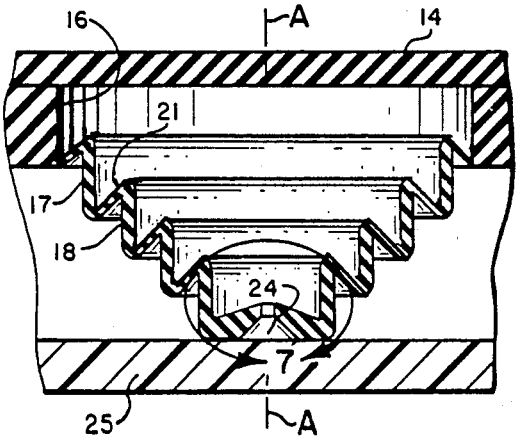
FIG. 5 is a cross section taken in the direction of the arrows 5—5 of FIG. 3.

Referring specifically to FIG. 5, the nested relationship of the annular walls 17, 18, 19 and 20 is more evident. It will be noted that the connecting portions such as indicated at 21 are thinner than the remaining wall portions which will facilitate the accordian or telescoping type collapsing of the entire air chamber or enclosure as will be described subsequently.

It will be noted by referring to the lower portion of FIG. 5 that the slotted air escape valve 24 in the lower end has an inverted V-shape in cross section. In FIG. 5, 25 designates the bottom of the shoe such as the shoe 13 described in FIG. 2 and it will be noted that the resilient rubberlike material making up the enclosure is biased to the position illustrated in FIG. 5 so that the chamber normally assumes its expanded state. It will be understood that the view of FIGS. 4 and 5 are greatly magnified.

Figure 6:
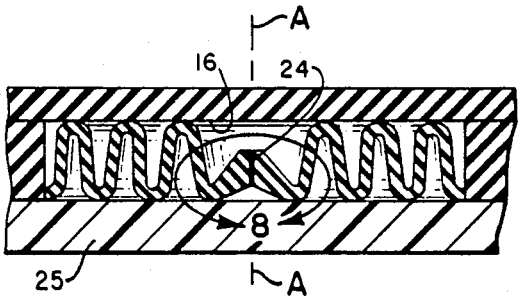
FIG. 6 is a view similar to FIG. 5 showing the structure when in a collapsed position.

When a person now walks on the inner sole, the plurality of enclosures will collapse under the weight of the person's foot. The collapsing will result in air escaping out some of the openings such as 22 and 23 and also out the end slot 24. The collapsing takes place in the manner of an accordion as clearly illustrated in FIGS. 5 and 6 wherein in FIG. 6 the entire air chamber or enclosure has been completely collapsed to position itself wholly within the circular recess 16. It will be evident that in this position, the valve 24 in the lower end of the enclosure it automatically closed because of the positioning of this last annular wall within the recess 16. Thus the side walls of the inverted V-shape are urged towards each other when collapsing of the enclosure takes place and all air is pushed out. As a result, there are no air pockets which might otherwise form thermal pockets.

When pressure is relieved, then the enclosure will expand out of the recess to assume the position illustrated in FIG. 5. The repeated collapsing and expansion of the various enclosures results in a breathing" of the sole which provides for a cooling of the wearer's foot, as well as the desired cushioning effect.

Since the construction is such as to provide the telescoping configuration, each of the enclosures or air chambers can collapse completely within the circular recess in the sole so that there are no "lumps" under completely collapsed condition. Moreover, the effective collapsing takes place at only a slight variable resistance because of the nesting construction and the fact that the connecting portions for the walls are of thinner material for effectively guiding the collapsing of the material.

Figure 7:
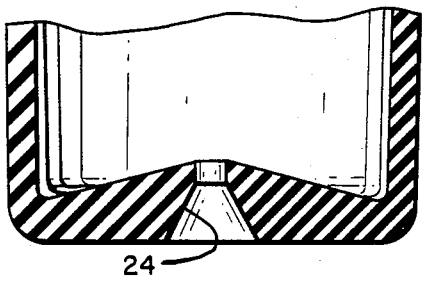
FIG. 7 is a greatly enlarged view of that portion of the structure enclosed within the circular arrow 7 of FIG. 5.

FIG. 7 shows in greatly enlarged view the smaller end opening 24 of the structure of FIG. 5.

Figure 8:
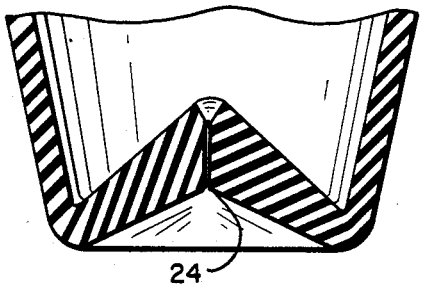
FIG. 8 is a view similar to FIG. 7 showing that portion of the structure enclosed within the circular arrow 8 of FIG. 6.

FIG. 8 shows how this opening is completely closed when pressure has been placed on the annular walls so that nesting or telescoping action takes place to close the opening 24.

Figure 9:
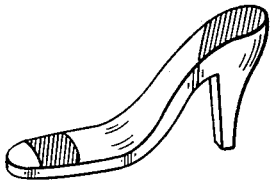
FIG. 9 shows a woman's sandal with which the present invention can be used.
Figure 10:
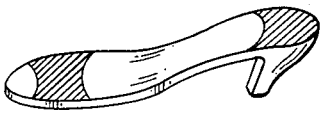
FIG. 10 shows a different style woman's sandal with which the present invention can be used.

FIGS. 9 and 10 show women's sandals wherein the enclosures 15 may be positioned in the shaded areas.

Figure 11:
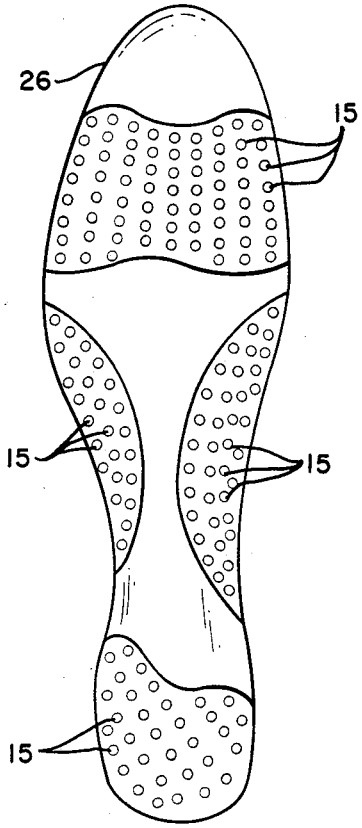
FIG. 11 is a top view showing how cut-out portions of the sole can be arranged on a woman's sandal.

An example is illustrated in FIG. 11 wherein there are various cut-outs for positioning various enclosures 15 at different areas of a sole 26.

Figure 12:
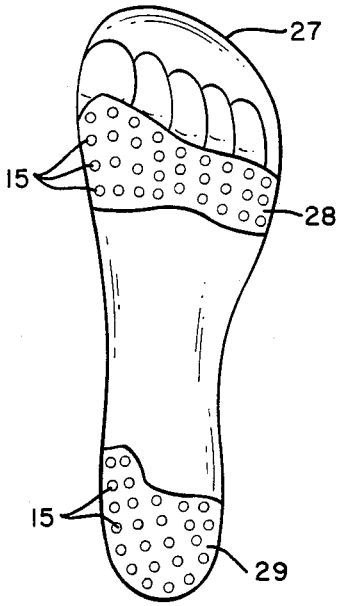
FIG. 12 is similar to FIG. 11 but shows differently shaped cut-outs to be used with a sandal or shoe.

FIG. 12 shows another sole 27 from the bottom wherein portions 28 and 29 represent cut-outs of the enclosures 15 illustrating positions beneath the ball and the heel of the foot.

Figure 13:
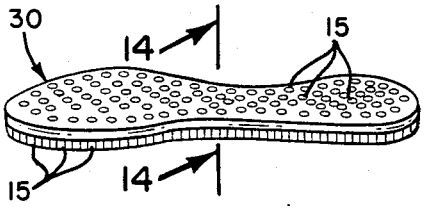
FIG. 13 shows a double layered sole.

FIG. 13 shows a double layered sole 30 in which enclosures 15 are formed on both the bottom and top.

Figure 14:
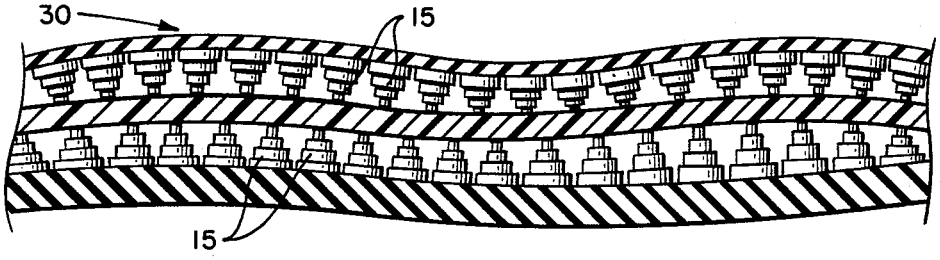
FIG. 14 is a greatly enlarged fragmentary cross section taken in the direction of the arrows 14—14 of FIG. 13.

The foregoing can better be seen in FIG. 14 showing a cross section of the double sole 30 wherein the upper and lower enclosures are shown at 15. This particular sole would be used where a super soft action is desired.

Figure 15:
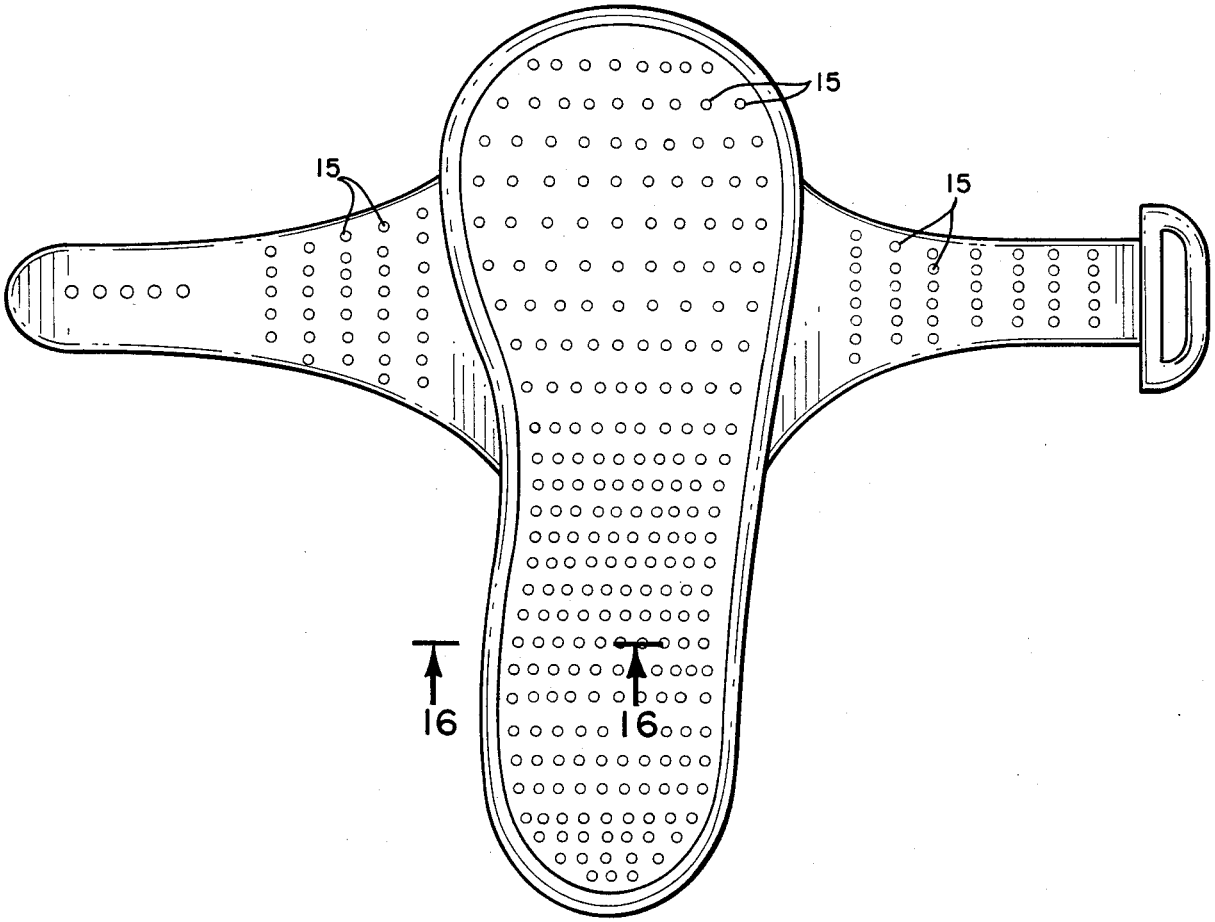
FIG. 15 is a top plan view of a health sandal with the closing straps spread apart; and, FIG. 16 is a fragmentary cross section looking in the direction of the arrows 16—16 of FIG. 15.

FIG. 15 shows a sandal like shoe with ribbon ties which would surround the in-step. The small enclosures 15 are here provided not only on the sole but on portions of the ties to provide cushioning action.

Figure 16:
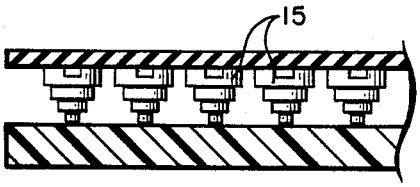

The cross-section of FIG. 16 shows three enclosures each similar to the enclosure shown in FIG. 5.

A distinctive feature of this invention in all of the embodiments illustrated is the telescoping or nesting action of the annular walls making up each enclosure into the circular recess as a person walks thereby eliminating shocks to joints, hips and the spine.

Various changes falling within the scope and spirit of this invention will occur to those skilled in the art. The shock absorbing shoe sole accordingly is not to be thought of as limited to the specific embodiment set forth for illustrative purposes.

I claim:

1. A shock absorbing shoe sole including, in combination:

(a) a supporting pad having a plurality of circular recesses on its underside; and (b) a like plurality of identical individual enclosures covering said recesses, each enclosure comprising a series of annular walls successively axially spaced from the recess associated with the enclosure and having successively decreasing diameters, the walls being in partially nested relationship, the extending end of each wall connecting to the beginning end of the next successive smaller diameter wall so that an accordion pattern results, the enclosure defining an air chamber, the connecting portions of the walls having air escape openings, the end of the smallest diameter wall having an air slot functioning as a valve whereby when a person walks on the sole, the various air chambers defined by the enclosures are repeatedly collapsed in telescoping, accordian fashion wholly into their associated recesses, all air being substantially exhausted to avoid any appreciable captured air which could act as heat retaining thermal air pockets, and expanded when pressure is relieved with each step, so that the sole breathes and keeps the wearer's foot cool, the same action resulting in a shock absorbing and cushioning action by the sole.

2. A shoe according to claim 1, in which said supporting pad and enclosures are on the bottom exterior of the shoe to define a tread for the shoe.

3. A shoe sole according to claim 1, in which said supporting pad and enclosures are receivable in the shoe to define an inner sole for the shoe.

4. A sole according to claim 1, in which said air slot is of inverted V-shape in cross section such that when the air chamber is collapsed, the sides of the V are urged together to close the slot.

5. A shoe sole according to claim 1, in which the connecting portions of the enclosure are thinner than the walls to facilitate the telescoping type collapsing of the enclosure.

6. A shoe sole according to claim 3, in which said supporting pad can be cut into various desired shapes for use in different positions in a shoe or sandal.

7. A shoe sole according to claim 1, including a double layer of enclosures in opposed relationship on either side of said supporting pad for providing an extemely soft cushioning action.

* * * * *